United States Patent [19]

Rieger

[11] Patent Number: 4,862,993

[45] Date of Patent: Sep. 5, 1989

[54] FIREPLACE FLUE AMBIENT NOISE REDUCING DEVICE

[76] Inventor: Heinz H. Rieger, 17 Martin Road, Toronto, Canada, M4S 2V1

[21] Appl. No.: 252,983

[22] Filed: Oct. 4, 1988

[51] Int. Cl.[4] ..... F01N 1/10

[52] U.S. Cl. ..... 181/211; 181/252; 181/256; 126/500

[58] Field of Search ..... 181/202, 203, 204, 211, 181/212, 240, 248, 249, 224, 252, 256, 282; 126/293, 120, 126, 135, 136, 142, 288

[56] References Cited

U.S. PATENT DOCUMENTS

| | | | |
|---|---|---|---|
| 3,894,610 | 7/1975 | Halter et al. | 181/256 |
| 4,036,324 | 7/1977 | Washbourne | 181/252 |
| 4,128,769 | 12/1978 | Bons et al. | 181/282 X |
| 4,174,700 | 11/1979 | Bartsch | 126/293 X |
| 4,239,091 | 12/1980 | Negoao | 181/252 X |
| 4,281,740 | 8/1981 | Weiss et al. | 181/252 X |

*Primary Examiner*—B. R. Fuller

*Attorney, Agent, or Firm*—David W. Wong

[57] ABSTRACT

A fireplace provided with a sound reducer is shown. The sound reducer eliminates ambient noise feeding back to the indoor through the flue system of the fireplace.

2 Claims, 1 Drawing Sheet

FIREPLACE FLUE AMBIENT NOISE REDUCING DEVICE

BACKGROUND OF THE INVENTION

This invention relates to fireplaces and particularly relates to a fireplace construction having a sound reducer for eliminating ambient noise from the flue system of the fireplace from feeding back into the indoor through the fireplace.

Commonly the smoke and exhaust gases of a fireplace are directed vertically through the chimney to the outdoor atmosphere. Usually the hot exhaust gases and smoke will rise vertically through the chimney without much difficulty. However, in some cases the exhaust flue or duct of the fireplace is provided in a horizontal position. This is particularly the case with fireplaces in a multi-storey apartment building. In such fireplaces, the exhaust flue above the fireplace extends substantially horizontally to exhaust through the side of the building to the outdoor rather than vertically upwards through the roof. Such horizontal flue is also commonly used in natural gas fireplaces and some central heating gas equipment. Due to the horizontal position of such flue system the flow of the hot exhaust gases and smoke through it is not efficient; and in order to enhance the flow of exhaust gases and smoke through such flue system usually an electric blower or a similar air mover device is incorporated into the flue system to create a desirable air current flowing from the fireplace to the outdoor so as to ensure that the exhaust gases and smoke from the fireplace are effectively expelled to the outdoor. Nevertheless,such blower and air mover devices are generally noisy, and the noise will feed back through the flue system to the fireplace and ultimately to the indoor to create an undesirable background noise in the room in which the fire place is located. Also, due to the relatively close proximity of the fireplace to the outside side wall of the building for the horizontal flue system, outdoor noise may also be feeding back to the indoor through the flue system and the fireplace.

SUMMARY OF THE INVENTION

It is an object of the present invention to provide a fireplace construction including a sound reducer for eliminating undesirable ambient noise.

It is another object of the present invention to provide a sound reducer having a simple structure and operative efficiently to eliminate undesirable ambient noise in fireplaces.

It is yet another object of the present invention to provide a sound reducer mounted immediately at the exhaust opening of the fireplace.

DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
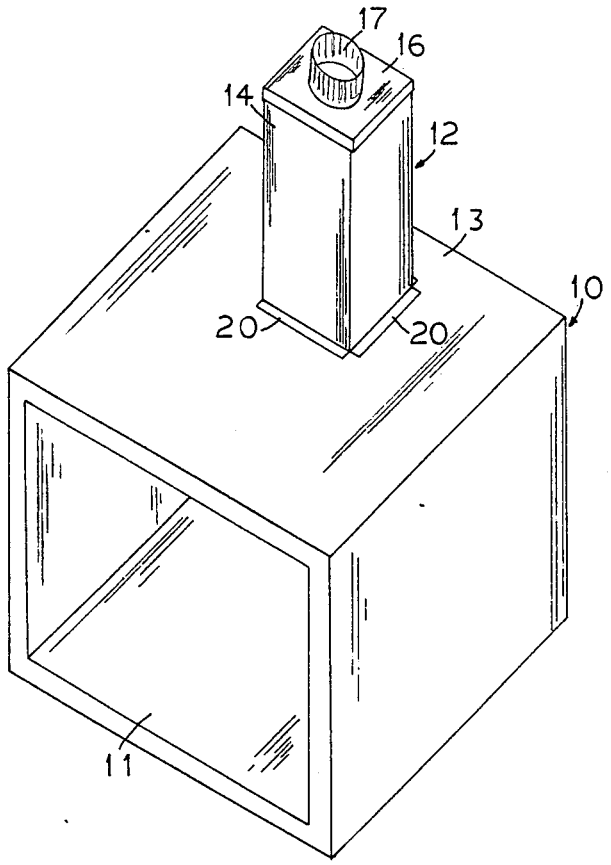
FIG. 1 is a perspective view of the fireplace construction having a sound reducer according to the present invention.
Figure 2:
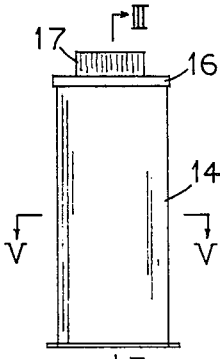
FIG. 2 is a side elevation view of the sound reducer according to the present invention.
Figure 3:
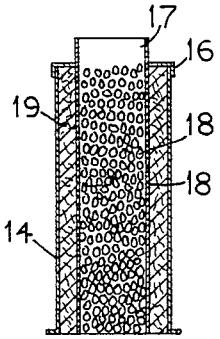
FIG. 3 is a sectional elevation view of the sound reducer along line III—III in FIG. 2.
Figure 4:
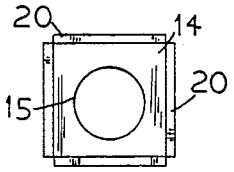
FIG. 4 is a bottom elevation view of the sound reducer.
Figure 5:
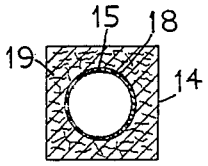
FIG. 5 is a sectional elevation view of the sound reducer along line V—V in FIG. 2.

The fireplace 10 of the present invention comprises, in general, a rectangular firebox 11 having a top exhaust opening. A sound reducer 12 is provided immediately at the exhaust opening over the top panel 13 of the fireplace firebox 11. The sound reducer 12 has an outer casing 14 and a concentric inner conduit 15. The outer casing 14 is preferably square in cross sectional shape; however, it may be of other convenient cross sectional shapes such as rectangular, circular or oval. The inside conduit 15 is preferably circular in cross sectional shape. The upper end of the outer casing 14 is provided with a cover 16. The inner conduit 15 extends throughout the entire length of the outer casing 14 and its upper end portion extends outside upwards beyond the cover 16 to form a coupling sleeve 17 for connection to the flue. The portion of the inner conduit 15 located within the outer casing 14 is provided with a plurality of perforations 18. The compartment between the inner casing and the outer casing 14 is filled with a sound absorptivie fibrous material 19 such as high temperature fibreglass wool. The sound reducer may be mounted to the top of the fireplace firebox with flanges 20 provided at the bottom end of the outer casing 14.

Although the preferred embodiment of the present invention has been described with some particularity, many modifications and variations are possible in the preferred embodiment without deviating from the invention. Accordingly, it is to be understood, that within the scope of the appended claims, the invention may be practised otherwise than as specifically described.

What is claimed is:

1. A fireplace comprising a firebox having a generally horizontal top panel, and an exhaust opening formed in said top panel, a sound reducing device mounted over said exhaust opening of said top panel and operative to be coupled to a noisy flue system for conducting exhaust gases from said fireplace to outdoor, said sound reducing device including an elongated inner conduit member for connecting to said exhaust opening and extending over a selected length over said top panel, an outer casing formed concentric to said inner conduit member, and having flanges located at a bottom end therein, said outer casing being mounted to said top panel by means of said flanges, said inner conduit member having a top portion extending upwards beyond a top end of said outer casing and operative for connecting to said flue system, a cover member disposed at said top end of said outer casing for enclosing said top end and forming an enclosed spacing between said outer casing and inner conduit means, said spacing being filled with a high temperature fibrous material, a plurality of openings formed in said selected length of said inner conduit member.

2. A fireplace according to claim 1 wherein said fibrous material is fibreglass wool.

* * * * *